US011761136B2

(12) United States Patent
Kim et al.

(10) Patent No.: US 11,761,136 B2
(45) Date of Patent: Sep. 19, 2023

(54) WASHING MACHINE

(71) Applicant: SAMSUNG ELECTRONICS CO., LTD., Suwon-si (KR)

(72) Inventors: Young-Hyun Kim, Suwon-si (KR); Young Jin Um, Suwon-si (KR); Kyu Nam Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 278 days.

(21) Appl. No.: 17/294,027

(22) PCT Filed: Oct. 28, 2019

(86) PCT No.: PCT/KR2019/014297

§ 371 (c)(1),
(2) Date: May 14, 2021

(87) PCT Pub. No.: WO2020/105882

PCT Pub. Date: May 28, 2020

(65) Prior Publication Data

US 2022/0002930 A1 Jan. 6, 2022

(30) Foreign Application Priority Data

Nov. 20, 2018 (KR) ..... 10-2018-0143341

(51) Int. Cl.

| | |
|---|---|
| ***D06F 37/24*** | (2006.01) |
| ***D06F 37/30*** | (2020.01) |
| ***D06F 37/40*** | (2006.01) |

(52) U.S. Cl.
CPC ..... *D06F 37/24* (2013.01); *D06F 37/304* (2013.01); *D06F 37/40* (2013.01)

(58) Field of Classification Search
CPC ..... D06F 37/24
See application file for complete search history.

(56) References Cited

U.S. PATENT DOCUMENTS

| | | |
|---|---|---|
| 10,190,250 B2 | 1/2019 | Jang et al. |
| 2005/0016226 A1 | 1/2005 | Okazaki et al. |

FOREIGN PATENT DOCUMENTS

| | | |
|---|---|---|
| JP | 3669332 | 7/2005 |
| KR | 1999-0051598 | 7/1999 |
| KR | 10-2004-0013992 | 2/2004 |
| KR | 10-2005-0064926 | 6/2005 |
| KR | 10-0499484 | 7/2005 |
| KR | 10-2008-0092023 | 10/2008 |

(Continued)

OTHER PUBLICATIONS

International Search Report dated Mar. 3, 2020 from International Application No. PCT/KR2019/014297, 7 pages.

(Continued)

*Primary Examiner* — Jason Y Ko
(74) *Attorney, Agent, or Firm* — STAAS & HALSEY LLP

(57) ABSTRACT

Provided is a washing machine with improved clutch-assembly structure for transmitting the power of a motor. A washing machine comprises: a water tub; a spin basket rotatably provided in the water tub; a pulsator rotatably provided in the spin basket; a motor configured to rotate the pulsator; a clutch housing coupled to the water tub; a lever holder coupled to the clutch housing; and a noise prevention member provided in the lever holder to reduce noise generated between the water tub and the motor.

15 Claims, 8 Drawing Sheets

(56) References Cited

FOREIGN PATENT DOCUMENTS

| | | |
|---|---|---|
| KR | 10-2015-0075626 | 7/2015 |
| KR | 10-2016-0114926 | 10/2016 |
| KR | 10-2016-0114926 A | 10/2016 |

OTHER PUBLICATIONS

Korean Office Action dated Mar. 14, 2023 for Korean Application No. 10-2018-0143341.

WASHING MACHINE

CROSS-REFERENCE TO RELATED APPLICATIONS

This application is a U.S. National Stage Application, which claims the benefit under 35 U.S.C. § 371 of PCT International Patent Application No. PCT/KR2019/014297, filed Oct. 28, 2019 which claims the foreign priority benefit under 35 U.S.C. § 119 of Korean Patent Application No. 10-2018-0143341, filed Nov. 20, 2018, the contents of which are incorporated herein by reference.

TECHNICAL FIELD

The disclosure relates to a washing machine having an enhanced structure of a clutch assembly for transferring power of a motor.

BACKGROUND ART

A washing machine is a machine for washing clothes with electric power, and may generally include a water tub for storing water, a rotating tub rotatably installed in the water tub, a pulsator rotatably installed on the bottom of the rotating tub, a motor for rotating the rotating tub and the pulsator, and a clutch assembly for transferring power of the motor to the rotating tub and the pulsator.

The washing machine may operate in such a manner that the pulsator rotates to form a water current inside the rotating tub to separate stains from the clothes while there are clothes and water in the rotating tub during a washing course and that the rotating tub and the pulsator rotate together to dissolve the separated stains in water during a rinsing course.

The washing machine may include the clutch assembly to switch from a pulsator rotation mode in which to transfer power of the motor to the pulsator to a rotating tub rotation mode in which to transfer power of the motor to both the pulsator and the rotating tub.

In the washing machine, drastic noise may be generated as a specific frequency of the water tub and a specific frequency of the motor approach each other in the washing course or the rinsing course. Especially when a resonance phenomenon occurs in which the specific frequency of the water tub and the specific frequency of the motor resonate, the noise may significantly increase.

Hence, the noise due to the resonance phenomenon may be reduced by separating the specific frequency of the water tub from the specific frequency of the motor as far as possible.

To separate the specific frequency of the water tub from the specific frequency of the motor, the motor itself may have reduced noise or the shape, weight, etc., of the water tub or the motor may be changed. Upward and downward changes in evasion to increase and decrease stiffness of the water tub or the motor may be available.

However, reducing the noise of the motor itself or increasing or decreasing the stiffness of the water tub or the motor corresponds to a change in design, which may make stiffness of the entire system change and increase material costs.

DISCLOSURE

Technical Problem

The disclosure provides a washing machine including a clutch assembly enhanced to reduce noise occurring in a washing or rinsing course.

The disclosure also provides a washing machine including a holder lever enhanced to prevent resonance between a specific frequency of a water tub and a specific frequency of a motor.

The disclosure also provides a washing machine including a noise prevention member inserted to a holder hole equipped at the holder lever to change the specific frequency of the motor.

Technical Solution

According to an aspect of the disclosure, a washing machine includes a water tub, a rotating tub rotatably provided in the water tub, a pulsator rotatably provided on the rotating tub, a motor provided to rotate the pulsator, a clutch housing coupled to the water tub, a lever holder coupled to the clutch housing, and a noise prevention member provided at the lever holder to reduce noise occurring between the water tub and the motor.

The lever holder may include a holder hole provided to be coupled with the motor, and the noise prevention member may be provided in the holder hole.

The noise prevention member may be inserted to the holder hole to prevent resonance between a frequency of the water tub and a frequency of the motor.

The noise prevention member may be insert-molded into the holder hole to prevent the noise prevention member from deviating from the holder hole.

The noise prevention member may include a different material from the lever holder.

The noise prevention member may include a metal.

The holder hole and the noise prevention member may be provided in the plural, and the plurality of noise prevention members may be provided in the plurality of holder holes to be spaced apart from each other.

The motor may include a stator, and the noise prevention members may be provided between the lever holder and the stator.

The noise prevention member may include an insertion portion to be inserted to the holder hole, and a bending portion bent from the insertion portion.

The bending portion may extend radially outward from the insertion portion to prevent deformation of the noise prevention member.

The lever holder may further include a motor coupler coupled with the motor, and a stepped portion protruding from the motor coupler to separate the bending portion from the motor coupler.

The bending portion may come into contact with the stepped portion and the stator.

The lever holder may further include a coupler with which the insertion portion comes into contact, and the coupler may include a slope to prevent the noise prevention member from deviating from the holder hole.

The noise prevention member may further include a stator hole arranged for the stator to be inserted thereto.

The bending portion may have thickness equal to or greater than height of the stepped portion.

According to another aspect of the disclosure, a washing machine includes a water tub, a rotating tub rotatably provided in the water tub, a pulsator rotatably provided on the rotating tub, a motor including a stator and a rotor provided to rotate the pulsator, and a clutch assembly provided to transfer power of the motor to the pulsator, wherein the clutch assembly may include a clutch housing, a lever holder coupled to a lower portion of the clutch housing and including a plurality of holder holes provided to be coupled to the stator, and a plurality of noise prevention members inserted to the plurality of holder holes separately to change a resonant frequency of the motor.

The noise prevention member may include a metal.

The noise prevention members may be provided between the lever holder and the stator.

According to another aspect of the disclosure, a washing machine includes a water tub having a rotating tub rotatably provided therein, a motor provided to rotate the rotating tub, a clutch housing coupled to the water tub, a lever holder coupled to the clutch housing and including a holder hole provided to be coupled to the motor, and a noise prevention member including an insertion portion to be inserted to the holder hole and a bending portion bent from the insertion portion.

The lever holder may further include a motor coupler coupled with the motor, and a stepped portion protruding from the motor coupler to separate the bending portion from the motor coupler.

Advantageous Effects

The disclosure may reduce noise occurring in a washing or rinsing course by enhancing a structure of a clutch assembly.

The disclosure may prevent noise generated from resonance between a specific frequency of a water tub and a specific frequency of a motor by enhancing a structure of a holder lever.

The disclosure may prevent the specific frequency of the motor from resonating with the specific frequency of the water tub by changing the specific frequency of the motor with a noise prevention member inserted to a holder hole equipped at a holder lever.

MODES OF THE INVENTION

Figure 1:
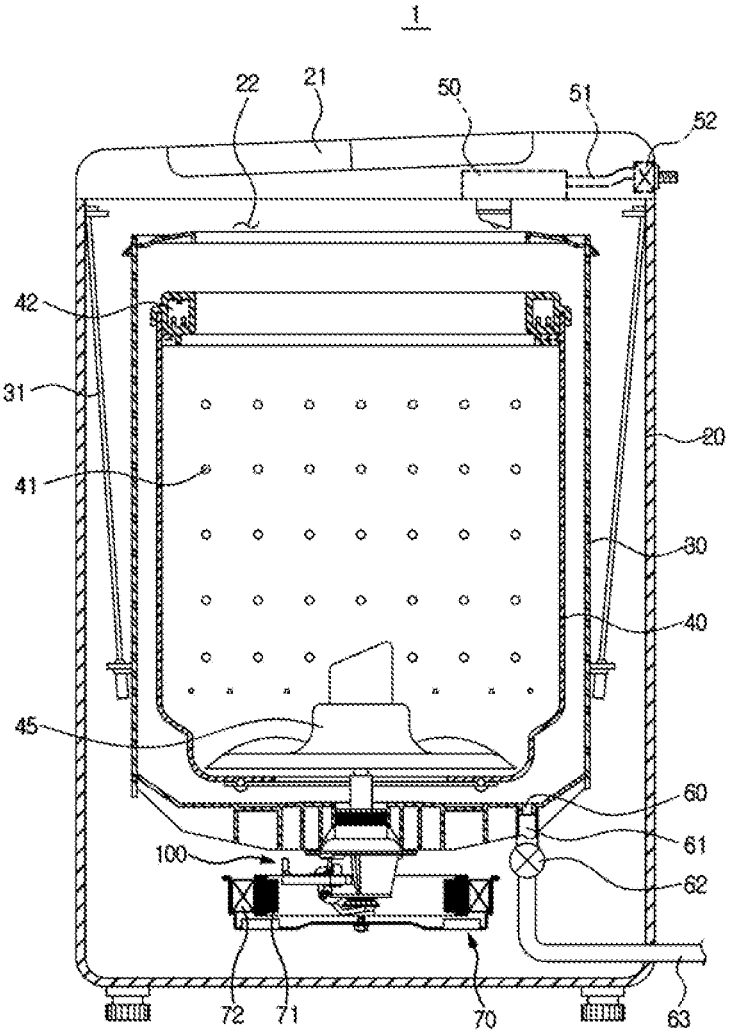
FIG. 1 is a cross-sectional view of a washing machine, according to the disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

For example, the first component may be termed as the second component, and vice versa, within the scope of the present invention. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments, examples of which are illustrated in the accompanying drawings, wherein like reference numerals refer to the like elements throughout.

FIG. 1 is a cross-sectional view of a washing machine, according to the disclosure. FIG. 1 is a cross-sectional view of a washing machine, according to the disclosure. As shown in FIG. 1, a washing machine 1 may include a cabinet 20 forming an exterior, and a water tub 30 provided inside the cabinet 20 to store water for washing.

The washing machine 1 may include a rotating tub 40 rotatably provided inside the water tub 30, and a pulsator 45 provided in the rotating tub 40 to generate a water current.

An inlet 22 may be formed on the top of the cabinet 20, through which to put laundry items into the rotating tub 40. The inlet 22 may be opened or closed by a door 21 installed on the top of the cabinet 20.

The water tub 30 may be supported by being hung on the cabinet 20 by a suspension device 31 that connects an outer side of a lower portion of the water tub 30 to an inner side of a top portion of the cabinet 20. The suspension device 31 may suppress transferring of vibrations generated from the water tub 30 to the cabinet 20 during washing or spin-drying.

A water supply tube 51 may be installed on the top of the water tub 30 to supply water into the water tub 30.

One end of the water supply tube 51 may be connected to an external water supply source (not shown) and the other end of the water supply tube 51 may be connected to a detergent supply device 50. Water suppled through the water supply tube 51 may pass through the detergent supply device 50 and may be supplied into the water tub 30 together with a detergent. A water supply valve 52 may be installed in the water supply tube 51 to control water supply.

The rotating tub 40 may be formed in a cylindrical shape with an open top and a side equipped with a plurality of dehydration holes 41 that connect inner space of the rotating tub 40 to inner space of the water tub 20.

A balancer 42 may be equipped on the top of the rotating tub 40 to help the rotating tub 40 stably spin around by offsetting an unbalanced load generated at the rotating tub 40 during high-speed rotation of the rotating tub 40.

The pulsator 45 may generate a water current while rotating forward or backward, and the laundry items and water in the rotating tub 40 may be stirred by the water current.

On the bottom of the water tub 30, a drain hole 60 may be formed to drain the water contained in the water tub 30, and the drain hole 60 may be connected to a first drain tube 61. A drain valve 62 may be installed in the first drain tube 61 for controlling water drain.

An outlet of the drain valve 62 may be connected to a second drain tube 63 for draining water to the outside. The drain valve 62 may be formed with various structures such as a solenoid device or a link device coupled to an electric motor.

On the bottom end of the water tub 30, a motor 70 may be provided to receive power to generate driving power. The motor 70 may include a stator 71 in a round shape, and a rotor 72 provided on the outer circumference of the stator 71.

A clutch assembly 100 may be provided between the motor 70 and the water tub 30 to transfer the driving power of the motor 70 selectively to the pulsator 45 or both the pulsator 45 and the rotating tub 40.

The washing machine 1 according to the disclosure in particular is shown to have a serial structure in which the motor 70 and the clutch assembly 100 are vertically connected in series. It is not, however, limited thereto.

Figure 2:
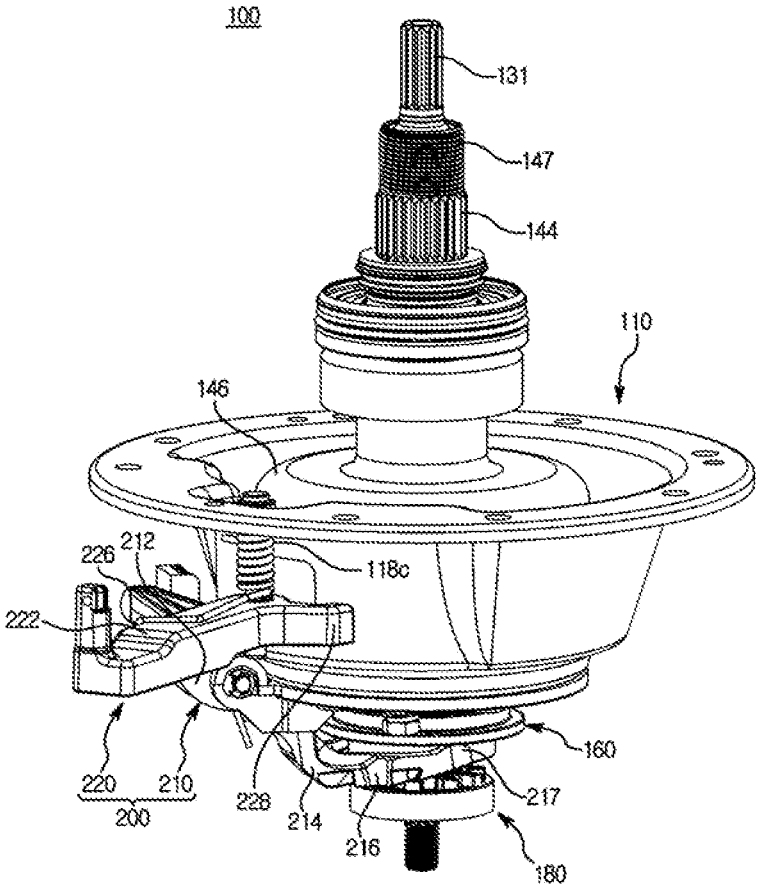
FIG. 2 illustrates a clutch assembly in a washing machine according to the disclosure.
Figure 3:
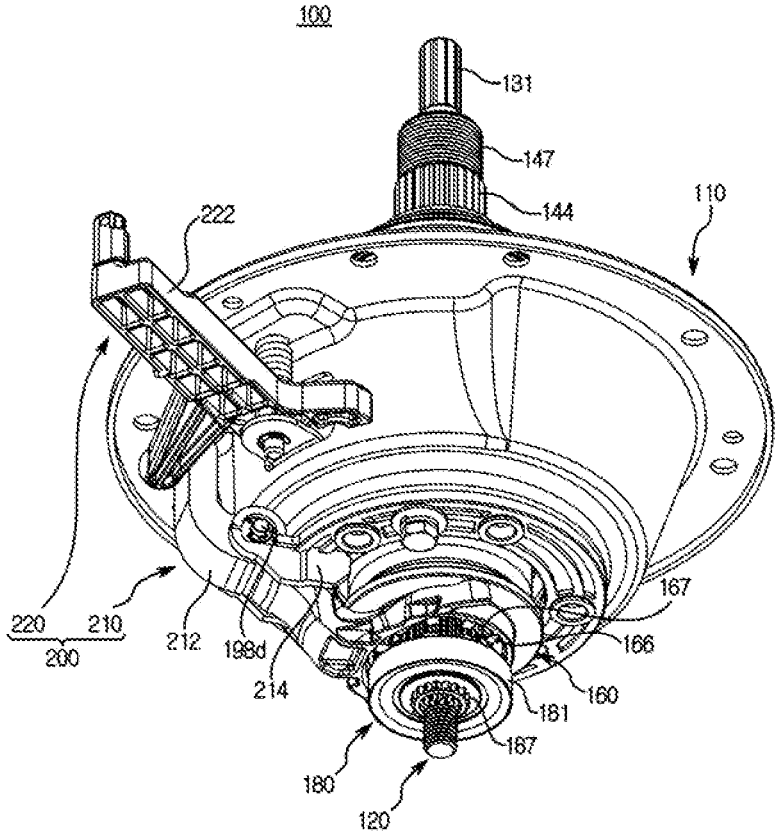
FIG. 3 illustrates a bottom portion of a clutch assembly in a washing machine according to the disclosure.
Figure 4:
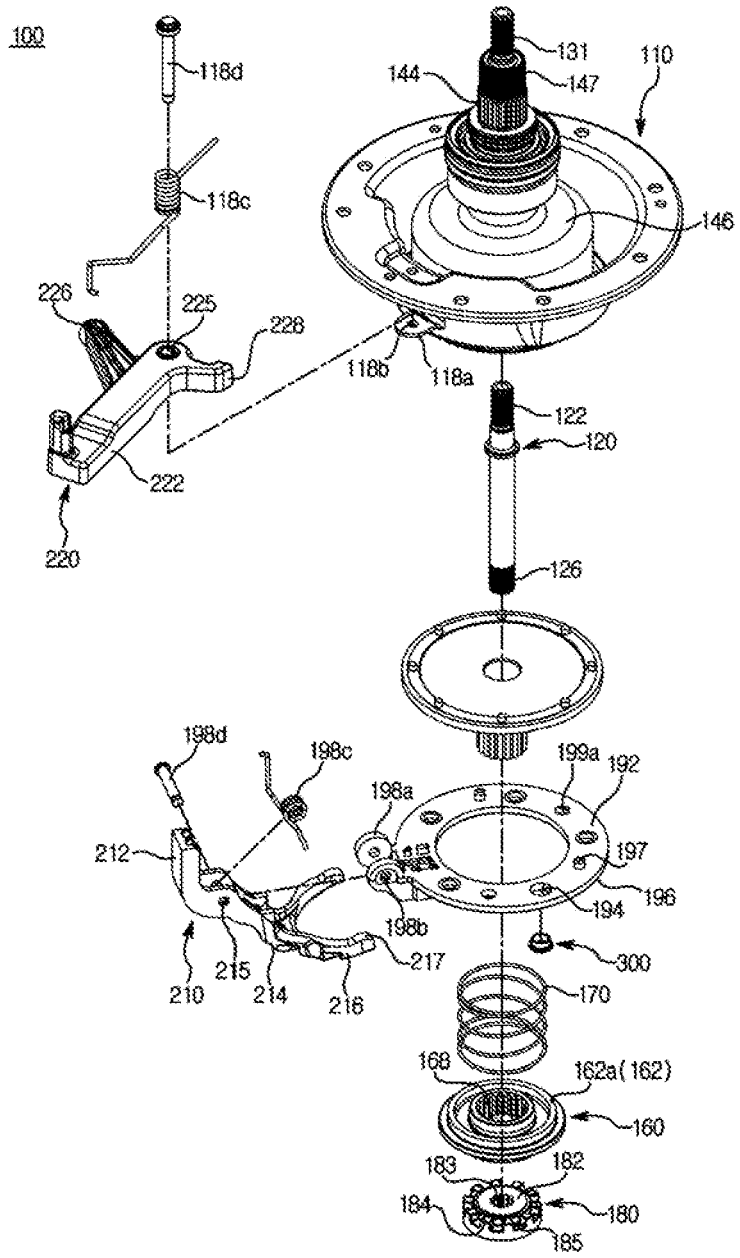
FIG. 4 is an exploded view of a clutch assembly in a washing machine according to the disclosure.
Figure 5:
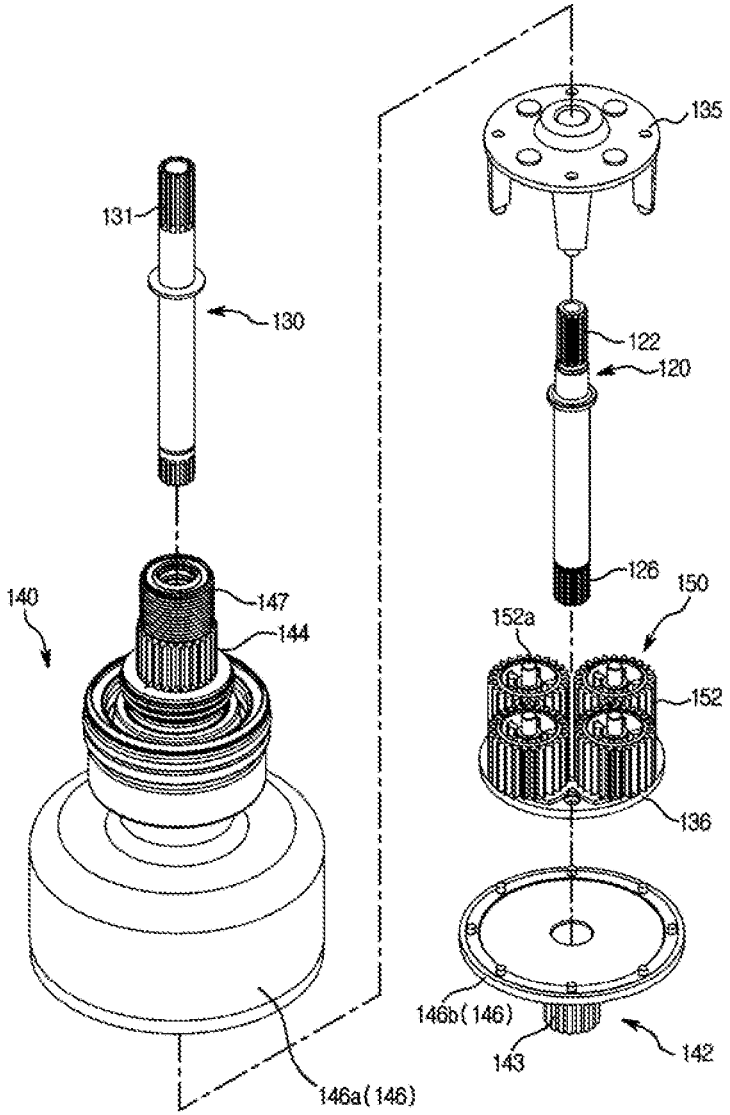
FIG. 5 is an exploded view of a rotating tub driver and a pulsator driver in a washing machine according to the disclosure.

FIG. 2 illustrates a clutch assembly in a washing machine according to the disclosure. FIG. 3 illustrates a bottom portion of a clutch assembly in a washing machine according to the disclosure. FIG. 4 is an exploded view of a clutch assembly in a washing machine according to the disclosure. FIG. 5 is an exploded view of a rotating tub driver and a pulsator driver in a washing machine according to the disclosure.

As shown in FIGS. 2 to 5, the clutch assembly 100 may be provided to receive power from the motor 70 (see FIG. 1) to transfer the driving power selectively to the pulsator 45 (see FIG. 1) or both the pulsator 45 and the rotating tub 40 (see FIG. 1).

The clutch assembly 100 may include a clutch housing 110 provided to protect internal structures of the clutch assembly 100. The clutch assembly 100 may include a driving shaft 120 and a pulsator driver 130.

The clutch assembly 100 may include a rotating tub driver 140 and a clutch boss 180.

A portion of the driving shaft 120 may protrude down from the clutch housing 110, and a portion of the rotating tub driver 140 and a portion of the pulsator driver 130 may protrude upward from the clutch housing 110.

The clutch boss 180 may include a boss hole 183 formed in the center and a hub 182 of a round shape surrounding the boss hole 183. The clutch boss 180 may include boss teeth 184 formed along the outer circumference of the hub 182. The clutch boss 180 may include a boss cover 181 that encloses the hub 182.

The clutch boss 180 is a part to which the driving power of the motor 70 is transferred first, and may have a boss gear 187 formed to protrude down from the hub 182 and correspond to serration formed on the inner circumferential surface of a hole of the rotor 72 (see FIG. 1).

The clutch boss 180 may always be rotated with the motor 70 as one body. The boss hole 183 may be formed to have a saw-toothed cross-section, and may perform a function of transferring the power to the driving shaft 120 coupled to the boss hole 183.

The driving shaft 120 may be connected to the clutch boss 180 so that the power generated from the motor 70 may be transferred to the pulsator driver 130 or both the pulsator driver 130 and the rotating tub driver 140.

The driving shaft 120 may be shaped like a rod, having one end at which a boss coupler 126 may be formed to be coupled to the clutch boss 180 and the other end at which serrated gear teeth may be formed to serve as a sun gear 122 of a planet gear assembly 150.

The boss coupler 126 may have a saw-toothed cross-section corresponding to the boss hole 183 to be inserted to the boss hole 183. Hence, the driving shaft 120 may always be rotated with the motor 70 as one body.

The pulsator driver 130 may include a pulsator shaft 131. The pulsator driver 130 may include a bottom planet gear coupler 136 on which a plurality of planet gears 152 are seated.

The bottom planet gear coupler 136 may be coupled to a top planet gear coupler 135 provided on top with the planet gears 152 located between the top planet gear coupler 135 and the bottom planet gear coupler 136.

The pulsator shaft 131 may be coupled to the top planet gear coupler 135 in the center, and may have one end coupled with the pulsator 45 to rotate the pulsator 45.

The rotating tub driver 140 may include a bottom rotating tub shaft 142 and a top rotating tub shaft 144. The bottom rotating tub shaft 142 and the top rotating tub shaft 144 may be rotated not separately but as one body.

The bottom rotating tub shaft 142 may enclose the driving shaft 120 located in the center. Rotating tub shaft teeth 143 may be formed on the outer circumference of the bottom end of the bottom rotating tub shaft 142.

The rotating tub shaft teeth 143 may have a serrated form in which a plurality of projections are separately provided along the outer circumferential surface of the bottom rotating tub shaft 142.

The rotating tub shaft teeth 143 may be selectively engaged with a rotating tub shaft coupler 168 of a coupling 160, and when the bottom rotating tub shaft 142 is coupled to the coupling 160, the power of the motor may be transferred to the rotating tub driver 140 through the coupling 160.

A gearbox base **146*b* in a flange shape may be provided at the top end of the bottom rotating tub shaft 142, and the top surface of the gearbox base 146*b* may face the bottom surface of the bottom planet gear coupler 136**.

A lubricant such as grease may be applied between the top surface of the gearbox base **146*b* and the bottom surface of the bottom planet gear coupler 136**.

The rotating tub driver 140 may include a gearbox 146 coupled onto the gearbox base **146*b* of the bottom rotating tub shaft 142. There may be a rotating tub coupler 147 on the opposite side of the gear box 146 of the top rotating tub shaft 144, and the rotating tub coupler 147 is coupled to the rotating tub 40 so that the power of the motor 70 may be transferred to the rotating tub 40**.

The top rotating tub shaft 144 is a cylindrical shaft having a cavity in the center, and the pulsator shaft 131 may be inserted to the cavity of the top rotating tub shaft 144.

As the top rotating tub shaft 144 and the pulsator shaft 131 have a gap to prevent contact between them, they may be rotated separately. The pulsator shaft 131 may protrude farther up than the rotating tub coupler 147 of the top rotating tub shaft 144 to be coupled to the pulsator 45.

The planet gear assembly 150 may be coupled to the driving shaft 120, the rotating tub driver 140, and the pulsator driver 130, and may be provided to transfer the power to the pulsator driver 130 or both the pulsator driver 130 and the rotating tub driver 140 from the driving shaft 120.

The planet gear assembly 150 may be provided inside the gearbox 146 that makes up a portion of the rotating tub driver 140.

The gearbox 146 may include a gearbox body 146*a* in a cylindrical shape having a larger diameter than the top rotating tub shaft 144 under the top rotating tub shaft 144, and the gearbox base 146*b* formed on the bottom rotating tub shaft 142 in the form of a flange.

The planet gear assembly 150 may include the sun gear 122, the plurality of planet gears 152, and a ring gear (not shown).

The planet gears 152 engaged with the sun gear 122 may be rotated or revolved by rotation of the sun gear 122. With the rotation of the planet gears 152, the ring gear may be rotated around the same axis as a rotation axis of the sun gear 122.

Herein, the rotation of the planet gears 152 may refer to the planet gears 152 being rotated around their respective rotation axes, and the revolution of the planet gears 152 may refer to the respective rotation axes of the planet gears 152 being revolved around the rotation axis of the sun gear 122.

The revolution of the planet gears 152 may involve rotations of the planet gears 152. When the rotation of the ring gear is bound, the rotation of the planet gears 152 may cause the planet gears 152 to be engaged with the ring gear and rotated around the sun gear 122.

On the other hand, when the revolution of the planet gears 152 is bound, the rotations of the planet gears 152 may cause the ring gear to be rotated.

The sun gear 122 may be provided at one end of the driving shaft 120. The driving shaft 120 may include the sun gear 122 provided in a serrated form on the outer circumferential surface on an opposite side from the side coupled to the clutch boss 180.

The driving power of the motor 70 may be transferred to the plurality of planet gears 152 and the ring gear through the sun gear 122 of the driving shaft 120.

The plurality of planet gears 152 may be connected to the pulsator driver 130. As the planet gears 152 are revolved around the sun gear 122, the rotational force may be transferred to the pulsator shaft 131.

The pulsator driver 130 may include a pair of planet gear couplers 135 and 136 coupled to the respective rotation centers of a plurality of planet gear shafts 152.

The pair of planet gear couplers 135 and 136 may rotatably support both ends of the plurality of planet gear shafts 152*a* so that they may be rotated around the rotation axis of the sun gear 122 during the revolution of the planet gears 152.

The planet gear couplers 135 and 136 may include a top planet gear coupler 135 and a bottom planet gear coupler 136. The center of the top planet gear coupler 135 may be coupled to the pulsator shaft 131.

The ring gear may be coupled to the rotating tub driver 140. The ring gear may enclose the plurality of planet gears 152 and may have the same rotation axis with the sun gear 122.

Serration formed on the inner side of the ring gear may be interlocked and rotated with serration formed on the outer circumference of the planet gears 152 so that rotation is made. The outer circumferential surface of the ring gear may be tightly fixed on the inner circumferential surface of the gearbox body 146*a*, so that the ring gear and the gearbox body 146*a* may be rotated as one body.

Hence, the driving power transferred to the ring gear may be transferred to the rotating tub driver 140. It is not, however, limited thereto, and the ring gear and the gearbox body 146*a* of the rotating tub driver 140 may be integrally formed.

The coupling 160 may transfer the power to the bottom rotating tub shaft 142 depending on the position. The driving shaft 120 and the bottom rotating tub shaft 142 may have the same rotation axis, and the coupling 160 may transfer the rotational force to the rotating tub shaft 142 by changing the position to a direction of the rotation axis.

The coupling 160 may include a coupling body 162 shaped like a cylinder with a cavity. The driving shaft 120 and the bottom rotating tub shaft 142 may pass through the cavity of the coupling body 162.

The coupling body 162 may include a top coupling body 162*a* and a bottom coupling body (not shown).

The rotating tub shaft coupler 168 may be provided along the inner circumferential surface of the top coupling body 162*a*, and coupling teeth 166 and coupling grooves 167 may be provided on the inner side of the bottom coupling body.

The coupling teeth 166 may protrude from the inner circumferential surface of the bottom coupling body. The coupling teeth 166 may have a shape of a plurality of projections protruding radially inward from the inner circumferential surface of the bottom coupling body, and the plurality of coupling grooves 167 may be provided between the coupling teeth 166.

The clutch assembly 100 may determine a position of the coupling 160 by operating a lever unit 200. The lever unit 200 may include a lever 210 and a trigger 220.

The lever 210 may include a top lever 212 and a bottom lever 214, and may have a form that bends from a lever pivot hole 215 formed in the middle between the top lever 212 and the bottom lever 214.

A pair of guide arms 216 in the shape of "C" branched in both directions at the end of the bottom lever 214 may be formed, and each guide arm 216 may include a coupling supporter 217 contacting and supporting the coupling 160.

The top lever 212 may contact the trigger 220 to receive force from the trigger 220, and the lever 210 may pivot around the lever pivot hole 215 by the force acting on the upper lever 212.

The trigger 220 may include a trigger bar 222 that forms a body, and a connecting arm 226 and a stopper 228 branched from an end of the trigger bar 222, and may be almost shaped like "T".

The trigger 220 may include the trigger bar 222, and a trigger pivot hole 225 formed in the middle between the connecting arm 226 and the stopper 228.

The trigger pivot hole 225 may be provided between a pair of trigger supports 118*a* formed on one side of the clutch housing 110.

A trigger support hole 118*b* may be formed at each of the pair of trigger supports 118*a*, and the trigger 220 may be pivotally mounted on the clutch housing 110 by trigger pivot pins 118*d* passing through the pair of trigger support holes 118*b* and the trigger pivot hole 225.

A trigger elastic member 118*c* may be provided between the trigger 220 and the trigger support 118*a*, so that the trigger 220 may be coupled to be biased in a direction of pushing the lever 210 or in the opposite direction.

The clutch assembly 100 may include a lever holder 190 (see FIG. 6) coupled onto the bottom surface of the clutch housing 110.

The lever holder 190 may include a ring-shaped holder body 196, and a housing coupler 192 for coupling the holder body 196 to the clutch housing 110. The lever holder 190 may include a coupling projection 197 protruding from the housing coupler 192 to be coupled to the clutch housing 110.

There may be two coupling projections 197. It is not, however, limited thereto.

The lever holder 190 may include a fastening hole 199*a* provided for a separate fastening member 199*b* (see FIG. 6) provided for fastening the lever holder 190 to the clutch housing 110 to pass through.

There may be two fastening holes 199*a*. It is not, however, limited thereto.

The lever holder 190 may include a pair of lever supports 198*a* protruding from a side of the holder body 196.

The lever holder 190 may be fixed by a plurality of fastening members 199*b* (see FIG. 6) onto the bottom surface of the clutch housing 110. It is not, however, limited thereto, and the lever holder 190 may be integrally formed with the clutch housing 110.

A lever support hole 198*b* may be formed at each of the pair of lever supports 198*a*, and the lever 210 may be pivotally mounted on the lever holder 190 by a lever pivot pin 198*d* passing through the pair of lever support holes 198*b* and the lever pivot hole 215.

A lever elastic member 198*c* may be provided between the lever 210 and the lever holder 190, so that the guide arm 216 of the lever 210 may be biased downward.

The lever holder 190 may include a holder hole 194 formed for the stator 71 to be inserted thereto.

According to the disclosure, the clutch assembly 100 may include a noise prevention member 300 provided to be inserted to the holder hole 194. The noise prevention member 300 will be described in detail later.

When the trigger 220 is operated by an actuator (not shown), the trigger 220 may pivot clockwise around the trigger pivot hole 225.

The connecting arm 226 may push the top lever 212 so that the lever 210 may pivot around the lever pivot hole 215, making the guide arm 216 of the lever 210 drop the coupling 160.

Although the washing machine 1 (see FIG. 1) according to the disclosure uses the lever 210 and the trigger 220 for a mechanism to change the position of the coupling 160, it is not limited thereto but may have a structure to use a cam or a gear to move the coupling forward and backward.

The boss teeth 184 may have the form of a plurality of projections protruding radially from the outer circumference of the hub 182, and a plurality of boss grooves 185 may be provided between the boss teeth 184.

The boss teeth 184 and the coupling teeth 166 are engaged at a position where the coupling 160 is dropped, enabling the power of the motor 70 to be transferred to the coupling 160, so that the coupling 160 may be rotated along with the clutch boss 180.

An operation principle of the clutch assembly 100 according to the disclosure will now be described in detail.

In a case that the washing machine 1 according to the disclosure operates in a pulsator rotation mode, no actuator may be operated. The actuator may apply no force to the trigger 220, so the trigger 220 may not pivot around but may remain in the original state.

As the trigger 220 does not push the top lever 212, elastic force of the lever elastic member 198*c* coupled to the lever pivot hole 215 may make the top lever 212 stand upright to be substantially parallel with the rotation axis of the motor 70. The guide arm 216 of the bottom lever 214 may support the coupling 160 upward. Accordingly, the coupling 160 may not be coupled to the clutch boss 180. However, the rotating tub shaft coupler 168 of the coupling 160 may be interlocked with the rotating tub shaft teeth 143.

Power from the driving shaft 120 may be transferred to the plurality of planet gears 152 through the sun gear 122.

Even though the power from rotation of the planet gear 152 is transferred to the ring gear, the rotating tub 40 weighs more than the pulsator 45, so the moment of inertia to rotate the rotating tub 40 that has been stopped may be significantly larger than the moment of inertia to rotate the pulsator 45 that has been stopped.

Hence, the rotational force of the planet gears 152 may make the planet gears 152 themselves revolve along with the ring gear instead of rotating the ring gear, and the revolution of the planet gears 152 may rotate the pulsator driver 130 and the pulsator 45 via the planet gear couplers 135 and 136.

The power of the motor 70 may be transferred to the pulsator driver 130 by revolution of the planet gears 152 through the sun gear 122 of the driving shaft 120 to rotate the pulsator 45.

In this case, the motor 70 and the pulsator 45 may have the same rotational direction, and the rotational speed of the pulsator 45 may be reduced as compared to the rotational speed of the motor 70.

The speed reduction ratio may depend on the number of gear teeth of the sun gear 122, the planet gear 152, or the ring gear.

In a case that the washing machine 1 according to the disclosure is operated in a rotating tub rotation mode, unlike in the pulsator rotation mode, the trigger 220 that receives force from the actuator may be rotated clockwise around the trigger pivot hole 225.

When force is applied to the top lever 212 by the rotation of the trigger 220, the lever 210 pivots around the lever pivot hole 215, preventing the guide arm 216 of the bottom lever 212 from pushing the coupling 160, so that the coupling 160 may fall down by the self-weight of the coupling 160 or elastic force of a spring 170.

The coupling teeth 166 of the coupling 160 may be interlocked with the boss teeth 184 of the clutch boss 180, and the rotating tub shaft teeth 143 of the bottom rotating tub shaft 142 may be interlocked with the rotating tub shaft coupler 168 of the coupling 160.

In the rotating tub rotation mode, the power of the motor 70 may be transferred not only to the driving shaft 120 but also to the coupling 160 coupled to the clutch boss 180. The rotating tub driver 140 may be rotated by the rotation tub shaft teeth 143 interlocked with the rotating tub shaft coupler 168 of the coupling 160.

Accordingly, as the driving shaft 120 and the rotating tub driver 140 have the same rotational speed, power transfer may not occur between the sun gear 122 of the driving shaft 120 and the planet gears 152, and no power transfer may occur between the planet gears 152 and the ring gear.

In other words, the pulsator driver 130 and the rotating tub driver 140 may be rotated as one rigid body.

Basically, the rotating tub rotation mode is a mode operated in a spin-dry course of the washing machine to separate water contained in the clothes by rotating the rotating tub 40 and the pulsator 45 at high speed.

Figure 6:
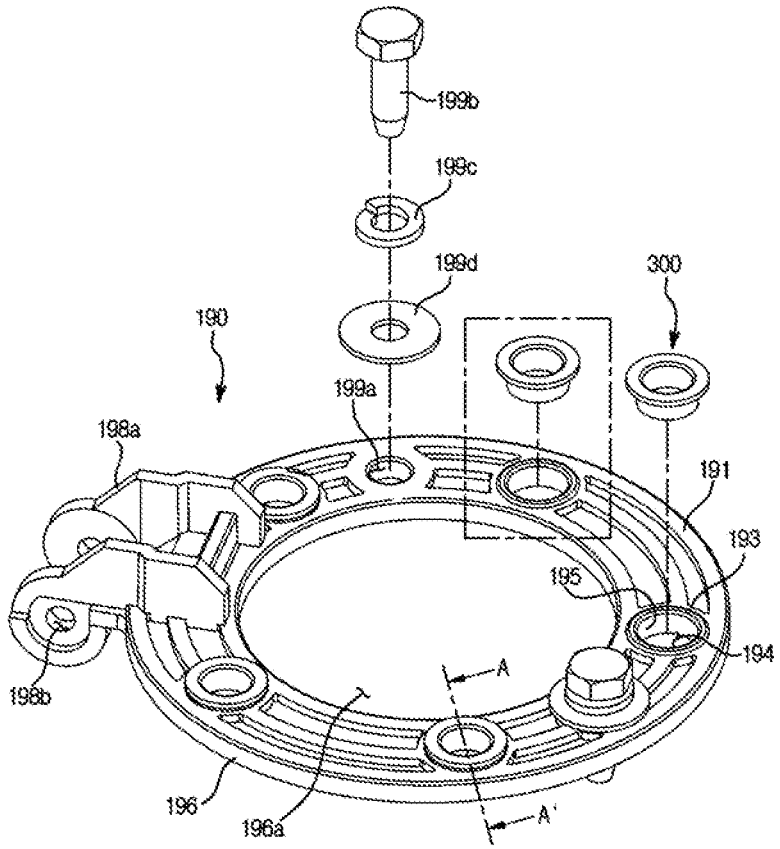
FIG. 6 illustrates a lever holder and a noise prevention member in a washing machine according to the disclosure.
Figure 7:
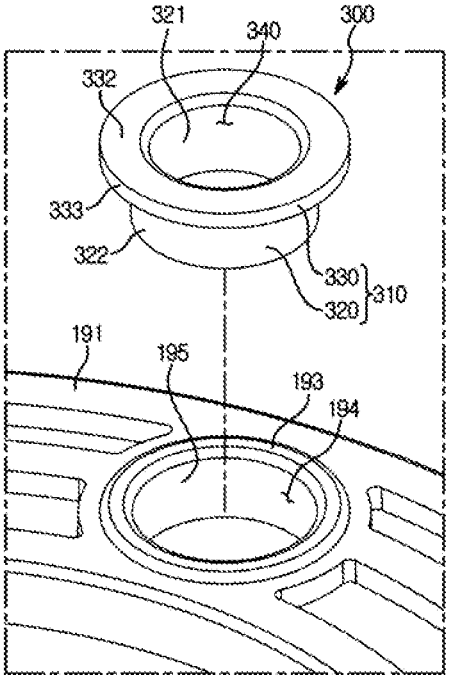
FIG. 7 is an enlarged view of portions of the lever holder and the noise prevention member shown in FIG. 6 in a washing machine according to the disclosure.
Figure 8:
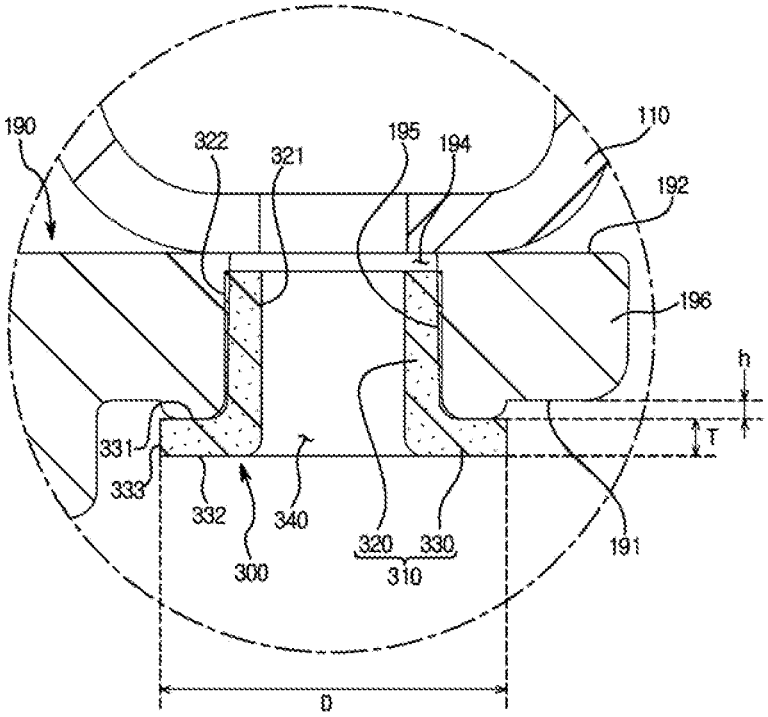
FIG. 8 is a cross-sectional view of the lever holder with the noise prevention member inserted thereto, which is viewed along A-A' shown in FIG. 6, in a washing machine according to the disclosure.

FIG. 6 illustrates a lever holder and a noise prevention member in a washing machine according to the disclosure. FIG. 7 is an enlarged view of portions of the lever holder and the noise prevention member shown in FIG. 6 in a washing machine according to the disclosure. FIG. 8 is a cross-sectional view of the lever holder with the noise prevention member inserted thereto, which is viewed along A-A' shown in FIG. 6, in a washing machine according to the disclosure.

As shown in FIGS. 6 to 8, the clutch assembly 100 (see FIG. 1) according to the disclosure may include the clutch housing 110 coupled to the water tub 30 (see FIG. 1), the lever holder 190 coupled to the clutch housing 110, and the noise prevention member 300 provided in the lever holder 190 to reduce noise generated between the water tub 30 and the motor 70 (see FIG. 1).

In the washing machine 1 (see FIG. 1), drastic noise may generally occur as a specific frequency of the water tub 30 and a specific frequency of the motor 70 approach each other during the washing course or the rinsing course. Especially when there is a resonance phenomenon in which the specific frequency of the water tub 30 and the specific frequency of the motor 70 resonate, the noise may significantly increase.

Hence, there is a need to reduce the noise from the resonance phenomenon by separating the specific frequency of the water tub 30 from the specific frequency of the motor 70 as far as possible.

To separate the specific frequency of the water tub 30 from the specific frequency of the motor 70, noise from the motor 70 itself may be reduced, or the shape, weight, etc., of the water tub 30 or the motor 70 may be changed.

A method of changing the shape, weight, etc., of the motor 70 may include upward changing in evasion to increase stiffness of the water tub 30 or the motor 70 and downward changing in evasion to decrease the stiffness of the motor 70.

However, reducing the noise of the motor 70 itself or increasing or decreasing the stiffness of the water tub 30 or the motor 70 corresponds to a change in design, which may make stiffness of the entire system change and increase material costs.

Accordingly, the clutch assembly 100 according to the disclosure may include the noise prevention member 300 provided in the lever holder 190 to reduce the noise of the motor 70 itself or reduce the noise generated between the motor 70 and the water tub 30 without changing stiffness of the water tub 30 or the motor 70.

The lever holder 190 may include the holder hole 194 formed to be coupled to the motor 70, and the noise prevention member 300 may be provided in the holder hole 194. The nose prevention member 300 may be inserted to the holder hole 194 to prevent resonance between the frequencies of the tub 30 and the motor 70.

The holder hole 194 is provided to couple the lever holder 190 to the clutch housing 110 and the stator 71 (see FIG. 1), and the clutch assembly 100 according to the disclosure may have the noise prevention member 300 in a simple structure inserted to the holder hole 194 provided to couple the lever holder 190 to the clutch housing 110 and the stator 71 instead of an extra mechanism, thereby preventing resonance between the specific frequencies of the motor 70 and the water tub 30.

The noise prevention member 300 may be insert-molded into the holder hole 194 to prevent the noise prevention member 300 from deviating from the holder hole 194. Vibrations transferred to the lever holder 190 during washing operation, especially spin-drying operation may make the noise prevention member 300 deviate from the holder hole 194.

Hence, the clutch assembly 100 according to the disclosure may enforce the coupling between the noise prevention member 300 and the lever holder 190 by insert-molding the noise prevention member 300 into the holder hole 194.

The noise prevention member 300 may include a different material from the lever holder 190. The noise prevention member 300 may include a metal. The noise prevention member 300 may include steel. It is not, however, limited thereto.

The noise prevention member 300 according to the disclosure may include a different material from the lever holder 190 provided between the motor 70 including the stator 71 and the clutch housing 110 coupled onto the bottom of the water tub 30 to change the specific frequency of the motor 70.

The noise prevention member 300 may downshift the specific frequency of the motor 70 by contacting the stator 71.

There may be a plurality of holder holes 194. There may be a plurality of nose prevention members 300. The number of the plurality of noise prevention members 300 may correspond to the number of the plurality of holder holes 194.

Although it is shown to have five holder holes 194 and five nose prevention members 300 according to the disclosure, the disclosure is not limited thereto. There may be as many holder holes 194 as they may prevent noise between the motor 70 and the water tub 30.

Each of the plurality of noise prevention members 300 may correspond to each of the plurality of holder holes 194. The plurality of noise prevention members 300 may be separately inserted to the plurality of holder holes 194.

Accordingly, rather than being integrally structured to be inserted to the plurality of holder holes 194, the noise prevention members 300 may be separately provided to be separately inserted to the plurality of holder holes 194, thereby significantly reducing the noise generated between the motor 70 and the water tub 30. It is not, however, limited thereto.

The noise prevention member 300 may be provided between the lever holder 190 and the stator 71. The noise prevention member 300 may contact the lever holder 190 and the stator 71.

The noise prevention member 300 may include a prevention member body 310 that forms the exterior of the noise prevention member 300. The prevention member body 310 may include an insertion portion 320 to be inserted to the holder hole 194, and a bending portion 330 bent from the insertion portion 320.

The prevention member body 310 may have the shape of a cylinder including a stator hole 340, which is a cavity. The bending portion 330 may be stepped from the insertion portion 320. The bending portion 330 may have a larger diameter than a diameter of the insertion portion 320.

The prevention member body 310 may have a substantially T-shaped cross-section. It is not, however, limited thereto.

The insertion portion 320 may include an insertion portion inner circumferential surface 321 that forms an inner circumferential surface of the cylindrical shape having the cavity, and an insertion portion outer circumferential surface 322 that forms an outer circumferential surface of the cylindrical shape having the cavity.

The bending portion 330 may include a bending portion top surface 331 that contacts the lever holder 190, and a bending portion bottom surface 332 that contacts the stator 71. The bending portion 330 may include a bending portion side surface 333 formed between the bending portion top surface 331 and the bending portion bottom surface 332.

The bending portion side surface 333 may extend from the bending portion top surface 331 and the bending portion bottom surface 332.

The bending portion 330 may extend radially outward from the insertion portion 320 to prevent deformation of the noise prevention member 300.

To reduce the noise between the water tub 30 and the motor 70, a contact area between the noise prevention member 300 and the stator 71 needs to be minimized. Hence, in a case that the noise prevention member 300 has the shape of almost a tube not including the bending portion 330 but including only the insertion portion 320 to be fully inserted to the holder hole 194, the noise between the water tub 30 and the motor 70 may be more significantly reduced.

However, in the case that the noise prevention member 300 is substantially shaped like a tube not including the bending portion 330 but including only the insertion portion 320 to be fully inserted to the holder hole 194, the noise prevention member 300 may be deformed when the noise prevention member 300 is insert-molded into the lever holder 190 through the holder hole 194.

Accordingly, the noise prevention member 300 according to the disclosure may minimize a contact area with the stator 71, but may include the bending portion 330 formed to prevent deformation of the noise prevention member 300 during insert-molding into the lever holder 190.

The lever holder 190 may include a motor coupler 191 to which the motor 70 is coupled, and a stepped portion 193 protruding from the motor coupler 191 to separate the bending portion 330 from the motor coupler 191. The bending portion 330 may contact the stepped portion 193 and the stator 71.

The stepped portion 193 may protrude downward from the motor coupler 191. The noise prevention member 300 may be inserted to the lever holder 190 up from the bottom side of the lever holder 190 through the holder hole 194.

The noise prevention member 300 according to the disclosure may further reduce noise occurring between the motor 70 and the water tub 30 by contacting only the stepped portion 193 to be separated from the motor coupler 191 unlike a case that the bending portion 330 contacts the motor coupler 191 without separation.

Thickness T of the bending portion 330 may be equal to or greater than height h of the stepped portion 193. A gap between the lever holder 190 and the stator 71 may need to be limited, so the thickness T of the bending portion 330 and the height h of the stepped portion 193 may also need to be limited.

However, when the thickness T of the bending portion 330 is too small, the noise prevention member 300 may be deformed when the noise prevention member 300 is insert-molded into the lever holder 190, so the bending portion 330 may have a minimum thickness T that may prevent deformation of the noise prevention member 300.

The lever holder 190 may include a coupler 195 with which the insertion portion 320 comes into contact, and the coupler 195 may include a slope to prevent the noise prevention member 300 from deviating from the holder hole 194.

The coupler 195 may make up the inner circumferential surface of the holder hole 194, and may have a slope that makes the diameter smaller toward the top. Accordingly, the noise prevention member 300 may be more securely coupled to the holder hole 194. It is not, however, limited thereto.

The top end of the insertion portion 320 inserted to the holder hole 194 may not contact the clutch housing 110 but may be separated from the clutch housing 110. In other words, the insertion portion 320 may have a height equal to or smaller than the height of the holder hole 194. It is not, however, limited thereto.

The noise prevention member 300 may include a stator hole 340 formed for the stator 71 to be inserted thereto. The insertion portion 320 may be provided between the stator 71 and the coupler 195.

The lever holder 190 may include a holder cavity 196*a* provided at the holder body 196.

The lever holder 190 may be fastened to the clutch housing 110 by a fastening member 199*b*. The lever holder 190 may include a fastening hole 199*a* provided for the fastening member 199*b* to pass through.

The lever holder 190 may be coupled to the clutch housing 110 by means of the fastening member 199*b*. There may be at least one washer 199*c* and 199*d* provided between the fastening member 199*b* and the lever holder 190 to act as a buffer against vibrations and prevent degradation of the fastening power of the fastening member 199*b*.

The washers 199*c* and 199*d* may include a spring washer 199*c* or a flat washer 199*d*. It is not, however, limited thereto.

The clutch housing 110, the lever holder 190, and the stator 71 may be sequentially coupled by the fastening member 199*b*. The fastening member 199*b* may pass through the stator 71, the fastening hole 199*a* of the lever holder 190, and the clutch housing 110.

Several embodiments have been described but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

The invention claimed is:

1. A washing machine comprising:

a water tub;

a rotating tub rotatably provided in the water tub;

a pulsator rotatably provided on the rotating tub;

a motor provided to rotate the pulsator;

a clutch housing coupled to the water tub;

a lever holder coupled to the clutch housing; and a noise prevention member provided at the lever holder to reduce noise occurring between the water tub and the motor.

2. The washing machine of claim 1, wherein the lever holder comprises a holder hole provided to be coupled to the motor, and wherein the noise prevention member is provided in the holder hole.

3. The washing machine of claim 2, wherein the noise prevention member is inserted to the holder hole to prevent a frequency of the water tub and a frequency of the motor from resonating with each other.

4. The washing machine of claim 2, wherein the noise prevention member is insert-molded into the holder hole to prevent the noise prevention member from deviating from the holder hole.

5. The washing machine of claim 1, wherein the noise prevention comprises a different material from the lever holder.

6. The washing machine of claim 5, wherein the noise prevention member includes a metal.

7. The washing machine of claim 2, wherein the holder hole and the noise prevention member are provided in the plural, and wherein the plurality of noise prevention members are provided in the plurality of holder holes to be spaced apart from each other.

8. The washing machine of claim 2, wherein the motor comprises a stator, and wherein the noise prevention member is provided between the lever holder and the stator.

9. The washing machine of claim 8, wherein the noise prevention member comprises an insertion portion to be inserted to the holder hole, and a bending portion bent from the insertion portion.

10. The washing machine of claim 9, wherein the bending portion extends radially outward from the insertion portion to prevent deformation of the noise prevention member.

11. The washing machine of claim 9, wherein the lever holder further comprises a motor coupler coupled with the motor, and a stepped portion protruding from the motor coupler to separate the bending portion from the motor coupler.

12. The washing machine of claim 11, wherein the bending portion comes into contact with the stepped portion and the stator.

13. The washing machine of claim 9, wherein the lever holder further comprises a coupler with which the insertion portion comes into contact, and wherein the coupler comprises a slope to prevent the noise prevention member from deviating from the holder hole.

14. The washing machine of claim 8, wherein the noise prevention member further comprises a stator hole arranged for the stator to be inserted thereto.

15. The washing machine of claim 11, wherein thickness of the bending portion is equal to or greater than height of the stepped portion.

* * * * *